United States Patent [19]

Peck

[11] Patent Number: 5,076,251

[45] Date of Patent: Dec. 31, 1991

[54] BOW STRING RELEASE WITH LINEAR MOTION SEAR AND PIVOT MOTION RELEASE

[75] Inventor: Paul L. Peck, Fond du Lac, Wis.

[73] Assignee: Tru-Fire Corporation, North Fond du Lac, Wis.

[21] Appl. No.: 518,957

[22] Filed: May 4, 1990

[51] Int. Cl.[5] ..... F41B 5/00

[52] U.S. Cl. ..... 124/35.2

[58] Field of Search ..... 124/35.2, 23.1, 25.6, 124/90; 24/136 A

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 3,898,974 | 8/1974 | Keck | 124/35.2 |
| 3,954,095 | 5/1976 | Lewis | 124/35.2 |
| 4,066,060 | 1/1978 | Napler | 124/35.2 |
| 4,403,594 | 9/1983 | Todd | 124/35.2 |
| 4,407,260 | 10/1983 | Lyons | 124/35.2 |
| 4,476,845 | 10/1984 | Rickard | 124/35.2 |
| 4,527,536 | 7/1985 | Smith | 124/35.2 |
| 4,860,720 | 8/1989 | Todd | 124/35.2 |
| 4,926,835 | 5/1990 | Peck | 124/35.2 |

*Primary Examiner*—Peter M. Cuomo
*Assistant Examiner*—Jeffrey L. Thompson
*Attorney, Agent, or Firm*—Andrus, Sceales, Starke & Sawall

[57] ABSTRACT

The bow string release includes a pair of sear elements which move in a linear motion relative to one another betweeen open and closed position in response to movement of a latch which pivots into and out of latching engagement with each of the sear elements.

10 Claims, 2 Drawing Sheets

FIG. 1
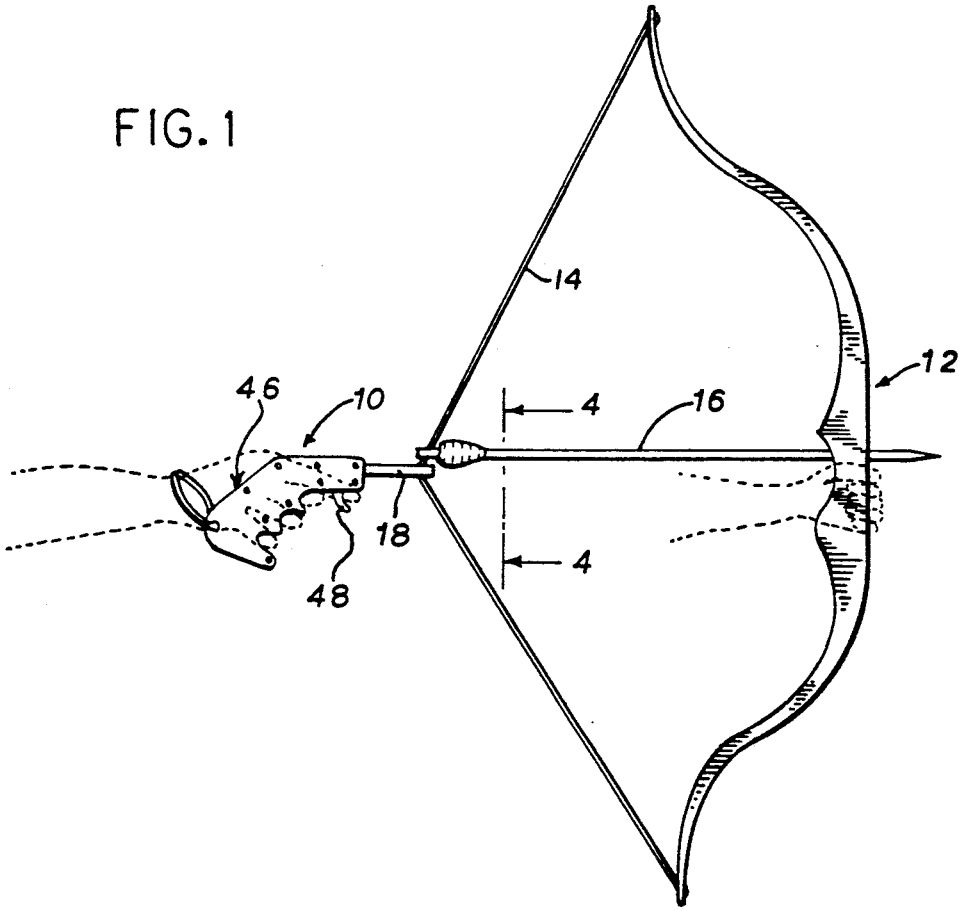
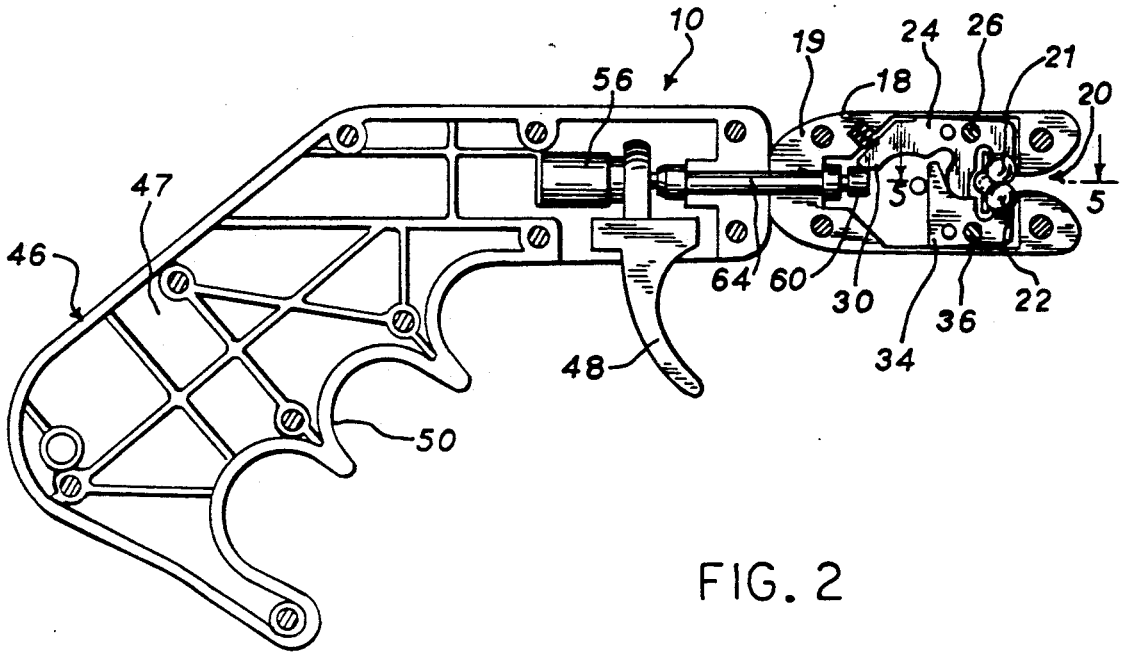
FIG. 2

BOW STRING RELEASE WITH LINEAR MOTION SEAR AND PIVOT MOTION RELEASE

BACKGROUND OF THE INVENTION

This invention relates to bow string releases of the type having a releasable sear for retaining a bow string, the sear including a pair of linear elements adapted for linear motion into and out of a closed position to retain the bow string.

Bow string releases have grown in popularity for target shooting and for hunting. A good release provides uniform release of the bow string and increases accuracy. The release is either hand-held or strapped to the wrist and has a trigger which permits the archer to release the string. Typically such devices employ a pivotal finger that engages the bow string, the finger being pivoted to a release position for releasing the string. Releases of this type are illustrated in U.S. Pat. Nos. 4,066,060; 3,898,974; and 3,954,095. It is known to use ball bearing elements in place of the pivotal finger to retain and release the string, wherein the ball bearing elements are held by a head and retained in position by a yoke or sleeve. A device of this type is illustrated in U.S. Pat. No. 4,403,594. While it is recognized that when the balls are separated by the tension of the string this provides minimal frictional engagement and a quiet release. Further, the balls do not produce a lateral bias on the string. However, this type of release has a significant disadvantage in that the amount of movement required to release the string is excessive when compared to the more common pivotal releases.

SUMMARY OF THE INVENTION

The bow string release of the present invention provides a synchronous, pivotable latch mechanism for releasing linear moving sear elements such as ball bearings. This design takes advantage of the superior features of linear sear mechanisms while retaining the advantages of pivotable trigger releases. In particular, the latch mechanism of the present invention includes a synchronous mechanism wherein each of the linear sears or balls are controlled by separate pivotable latch releases which move in sychronized motion upon activation of the trigger release. This permits the trigger to have a "feel" similar to that of other pivotable bow string releases while taking advantage of some of the superior features of linear motion sear elements.

The advantages and features of the invention will be more readily understood by reference to the drawings and detailed description which follow.

BRIEF DESCRIPTION OF THE DRAWINGS

FIG. 1 illustrates the bow string release of the present invention in typical use with a bow and arrow.

FIG. 2 is an enlarged view of the release of FIG. 1, with the head rotated 90° and the covers removed.

DETAIL DESCRIPTION OF THE INVENTION

Figure 3:
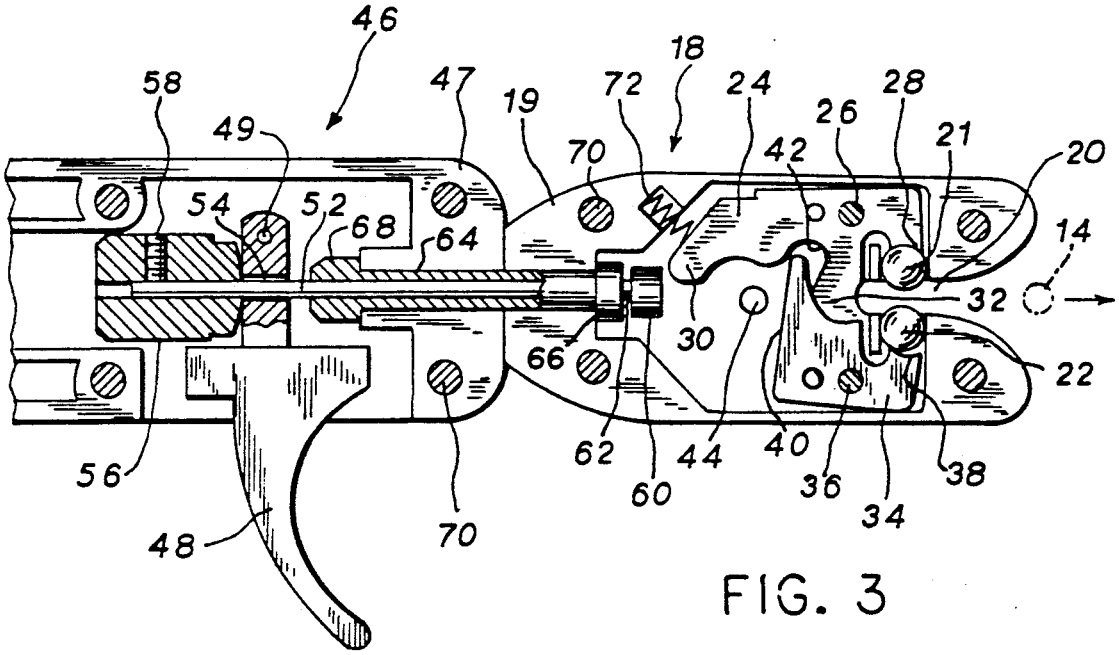
FIG. 3 is an enlarged fragmentary view of the release, looking in the same direction as FIG. 2.

As shown in FIG. 1, the bow string release 10 of the present invention includes a head 18 with the sear mechanism for retaining the bow string 14 of a typical bow 12 and a body 46 including a trigger 48 for releasing the string. When the trigger 48 is activated or pulled, the sear mechanism is opened to release the string 14 and fire the arrow 16. The novel features of the release are best shown in FIGS. 2 and 3, where the head 18 has been rotated 90° into alignment with the trigger grip 46 and the covers 29 and 57 have been removed to expose the working mechanism.

Figure 5:
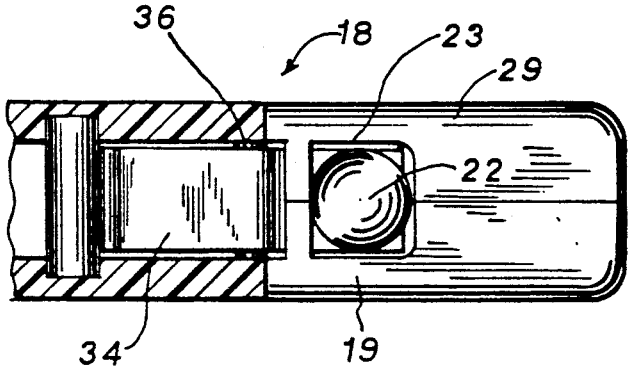
FIG. 5 is an enlarged fragmentary view taken at arrow 5 of FIG. 2.

The head 18 includes a base 19 with suitable recesses for carrying a pair of sear elements such as the balls 21 and 22 mounted in communication with the string retaining notch 20 of the head. The balls 21 and 22 are mounted in typical fashion for linear movement into and out of notch 20 and are shown in the extended, closed position in FIG. 2 and the retracted, open position in FIG. 3. As shown in FIG. 5, the base 19 and cover 29 of the head 18 form a window 23 through which the ball 22 extends. The window 23 is slightly smaller than the diameter of the ball, wherein the ball is retained in the head unless the cover 29 is removed from the base. Thus, the ball is free to move in a linear fashion in and out of the window 23 between the closed and open positions. While ball sear elements are described, it will be understood that any linear motion sear elements will work well with the design of the present invention.

Each ball 21 and 22 is in communication with a respective sear latch element 24 and 34. The sear latch element 24 is pivotably mounted on post 26. The sear latch 34 is pivotably mounted on post 36. Each latch element 24 and 34 has a ball receptive seat 28 and 38 for receiving balls 21 and 22 respectively.

The extension tab 30 of the sear latch element 24 is in communication with the head 60 of the push pin 64 of the trigger mechanism. The sear latch 24 is activated directly by the trigger release 48 and its movement controls the movement of the follower latch element 34. The finger 40 in the follower element 34 fits into the notch 42 provided in the controlling element 24. The self-locking tab 32 provided on the controlling element 24 engages the finger 40 and holds the follower element 34 in a closed position whenever the controlling element 24 is in the latched closed position as shown in FIG. 2.

The body 46 typically includes a base 47 with a trigger release 48 suitably pivotably mounted at the post 49. The base 47 and cover 57 (FIG. 4) typically define a handle grip 50 by which the release is held. A latch release mechanism such as the pull pin 52 is in engagment with and moves with the trigger release 48, as illustrated by the through hole 54 through which the pin passes to be received in retainer 56 and secured therein by set screw 58. The pin 64 may be adjustably retained in the retainer 56 to adjust the amount of trigger pull required to activate the sear.

Figure 4:
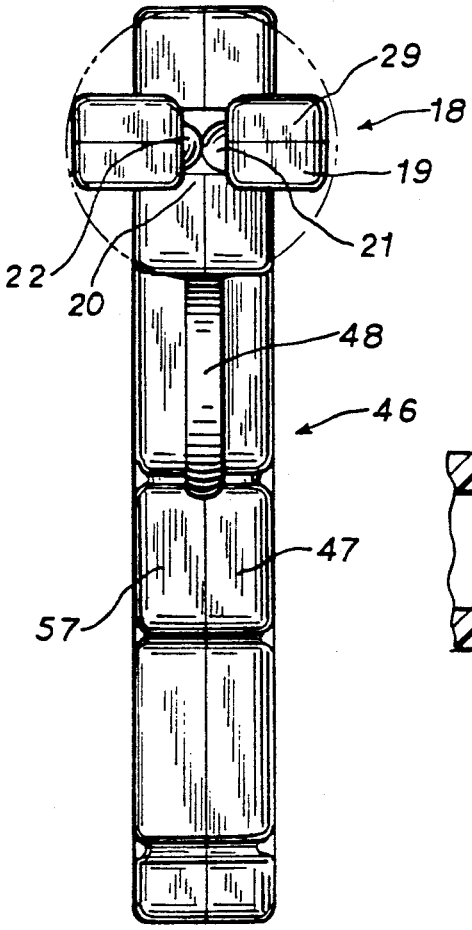
FIG. 4 is a view taken at arrow 4 in FIG. 1.

In the illustrated embodiment, the head 18 and grip 46 are mounted for rotation on a hollow cylindrical shaft 64 having enlarged ends 66 and 68. When the covers 29 and 57 are placed on the head base 19 and the grip base 47, respectively, and held in place by means such as the screws 70 or the like, the head and grip are held in secure assembly on shaft 64 and may be rotated 360° relative to one another as shown in FIG. 4.

The pin 52 extends through the hollow shaft 64 and includes an enlarged head 60 suited for engagement with the latch extension tab 30 of the controlling latch 24. A compression spring 62 is mounted between the end 66 of the shaft and the pin head 60 to urge the pin toward and into engagement with the latch extension tab 30. When the trigger release 48 is pulled toward the grip 50, the pin retainer 56 is moved back, pulling the pin 64 head 60 away from the latch extension tab 30. The force of the bow string 14 pushes the balls 21 and 22 into the open retracted position and the string is released (FIG. 3).

A compression spring 72 is seated in a suitable recess in the head and urges the latch element 24 into the opened, retracted position once the string is released. When the string is reinserted in the notch 20, it engages the self-locking ear 32 of the controlling latch element 24 and overcomes the force of spring 72 to urge the latch element 24 back into the closed position (FIG. 2). The extension tab 30 pivots up over the pin head 60 and the spring 62 urges the pin into latching engagement with the latch element. Self-locking ear 32 engages the follower finger 40 of the latch element 34 and likewise urges it and the ball 22 into the closed position. The string is now reloaded and ready to fire. The post 44 can provide a positive stop for limiting the forward movement of the latch element 29 when it is unlatched. The tab 30 will pivot toward and be stopped by post 44, assuring that the assembly does not move beyond acceptable limits when the string is released.

While specific features and embodiments of the invention have been shown and described herein, it will be readily understood that the invention encompasses all modifications and alternatives within the scope and spirit of the following claims.

What is claimed is:

1. A bow string release of the type having a head with a pair of linear motion sear elements mounted therein for linear movement along an axis substantially normal to the plane containing the bow and the bow string between a latched, closed, string retaining position and an unlatched open, string releasing position, a releasable latch in communication with the sear elements, and a body with a trigger mechanism for normally maintaining the latch and sear elements in the closed position, the trigger mechanism movable to release the latch and sear elements to the open position, the latch further comprising:

a. a first latch element pivotally mounted in the head and movable in a plane parallel to the axis of sear movement, said first latch element in communication with one of said sear elements, said first latch element pivotable between the opened and closed positions;

b. a second latch element pivotally mounted in the head and movable in a plane parallel to the axis of sear movement, said second latch element in communication with the other of said sear elements, said second latch element pivotable between the open and closed positions; and c. release means on each latch element responsive to movement of the trigger mechanism for releasing the latch elements from the closed to the opened positions, wherein the first latch element is a controlling element in direct communication with the trigger mechanism and is directly responsive to movement of the trigger mechanism and wherein the second latch element is a follower element with release means in direct communication with the controlling element and is directly responsive to movement of the controlling element.

2. The bow string release of claim 1, wherein the sear elements are a pair of balls mounted in the head in communication with the latch elements and are adapted for linear movement relative to one another.

3. The bow string release of claim 1, wherein one of said latch elements includes a string intercepting means, wherein said means intercepts the bow string when it is inserted in the head and is moved therewith to pivot the latch and its respective sear element into the closed, latched position.

4. The bow string release of claim 3, wherein the other of said latch elements includes a follower finger in communicaton with the string intercepting means, whereby movement of said means causes movement of the follower finger to pivot said other latch element and its respective sear element into the closed, latched position.

5. The bow string release of claim 3, further including means in said head for normally biasing the latch elements into the open position.

6. The bow string release of claim 1, wherein the body includes a grip separate from the head, a trigger release mounted in the grip and means for communicating the trigger release in the grip with the latch in the head.

7. The bow string release of claim 6, further including mounting means for carrying both the grip and the head in rotational relationship to one another, the trigger communicating means passing from the grip to the head through said mounting means.

8. A bow string release of the type having a head with a pair of balls mounted therein for linear movement between a latched, closed, string retaining position and an unlatched, open, string releasing position; a pivotal releasable latch in communication with the balls; and a body including a grip and a trigger release for normally maintaining the latch and balls in the closed position, the trigger release movable to release the latch and sear elements to the open positon, the latch further comprising:

a. a controlling latch element pivotally mounted in the head and in direct communication with one of said sear elements and the trigger release, said first latch element responsive to movement of the trigger release to release the controlling latch element from the closed to the opened position;

b. a follower latch element pivotably mounted in the head and in communicaton with the other of said sear elements, said follower latch element including means in direct communication with the controlling latch element and responsive to movement thereof to release the follower latch element from the closed to the opened positon;

c. a string intercepting means on one of said latch elements for intercepting a bow string as it is inserted in the head and for moving the latch elements to a closed, latched position in response to insertion of the string; and d. means in the head and in communication with the latch elements for normally biasing the latch elements in the open, unlatched position.

9. The bow string release of claim 8, wherein the string intercepting means is a tab on the controlling latch element and the follower latch element includes a follower finger in direct communication with and adapted to follow the movement of the tab.

10. The bow string release of claim 8, wherein the body includes a wrist strap attached thereto.

* * * * *